United States Patent [19]

Tucholski

[11] 4,223,545

[45] Sep. 23, 1980

[54] SWAGING TOOL ASSEMBLY

[76] Inventor: George T. Tucholski, R.D. #1, Box 364, Orwell, Ohio 44076

[21] Appl. No.: 907,297

[22] Filed: May 19, 1978

[51] Int. Cl.[3] ..... B21D 7/02; B21D 41/02

[52] U.S. Cl. ..... 72/206; 72/217; 72/294; 72/306; 72/317; 72/454; 72/464

[58] Field of Search ..... 72/306, 294, 316, 317, 72/318, 464, 217, 218, 454, 472, 404, 206; 29/40

[56] References Cited

U.S. PATENT DOCUMENTS

| | | | |
|---|---|---|---|
| 280,862 | 7/1883 | Reach | 72/217 |
| 2,211,242 | 8/1940 | McIntosh | 72/294 |
| 2,662,574 | 12/1953 | Franck | 72/317 |
| 3,696,654 | 10/1972 | Bohn | 72/409 |

*Primary Examiner*—Ervin M. Combs
*Attorney, Agent, or Firm*—Howard I. Podell

[57] ABSTRACT

A swaging tool assembly for also bending, cutting and flaring tubing which includes a tubing holding block connected to a tool support by a sliding stabilizer bar and a main bar rotated by a speed bar handle. The block has a cutter wheel cooperating with tube guides on the tool support. On the upper part of the support is rotatably mounted a head from which project a plurality of conically configurated flaring ends for flaring by swaging a tube held at one end in a seat on the block. A bending lever with telescopic handle is pivoted eccentrically to the lower end of the support which has tube bending means.

6 Claims, 1 Drawing Figure

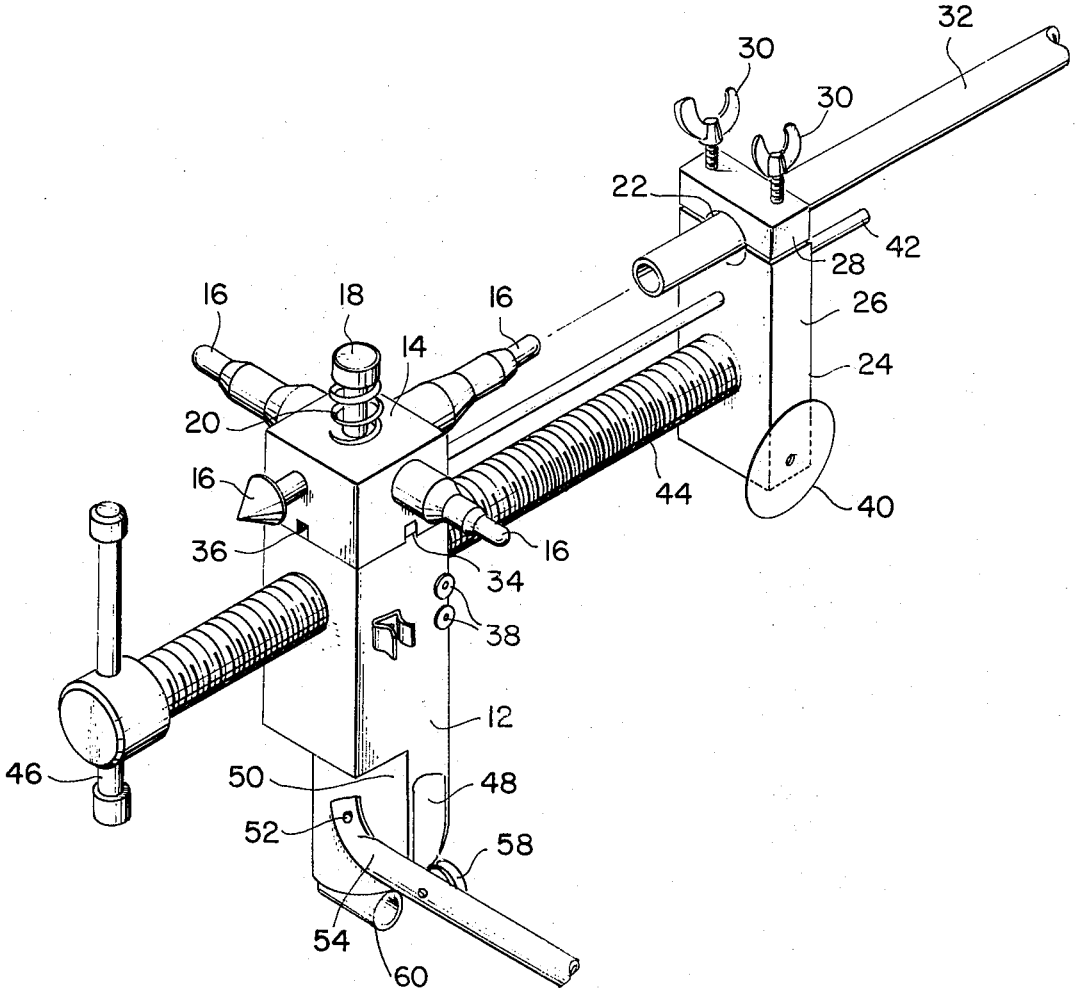
32
30
30
22
42
28
26
24
16
18
16
14
20
16
44
40
36
16
34
38
12
46
50
48
52
58
54
60

SWAGING TOOL ASSEMBLY

FIELD OF THE INVENTION

This invention relates generally to a swaging tool assembly for performing various operations on copper tubing.

DESCRIPTION OF THE PRIOR ART

The prior art, as exemplified by U.S. Pat. Nos. 3,495,432; 3,575,033; 3,959,998; 3,421,354; and 3,218,837 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a swaging tool assembly for also bending, cutting and flaring tubing which includes a tubing holding block connected to a tool support by a sliding stabilizer bar and a main bar rotated by a speed bar handle. The block has a cutter wheel cooperating with tube guides on the tool support. On the upper part of the support is rotatably mounted a head from which project a plurality of conically configurated swaging flaring ends for flaring a tube held at one end in a seat on the block. A bending lever with telescopic handle is pivoted eccentrically to the lower end of the support which has tube bending means.

BRIEF DESCRIPTION OF THE DRAWING

In the accompanying drawing, in which is shown one of the various possible illustrative embodiments of this invention, wherein like reference character identify the same or like parts:

FIG. 1 is a view in perspective showing the tool of the invention.

DESCRIPTION OF THE PREFERRED EMBODIMENTS

With reference to the drawing, there is shown and illustrated a swaging tool assembly constructed in accordance with the principles of the invention and designated generally by reference character 10. The illustrated tangible embodiment of the invention includes a metal tool support 12 on the upper part of which is rotatably mounted a swaging head 14 from which radiate a number of conically configurated swaging flaring ends 16. These ends have diameters corresponding to the various popular tube sizes. Head 14 is pivoted on support 12 by means of spring-held pin 18. Spring 20 is helically wound on pin 18 and gets tighter as progressively smaller flaring ends are presented to countersunk flaring seat 22 in block 24 formed by clamping elements 26 and 28 connected by wing nuts 30. The tube to be swaged or flared is designated by number 32.

Tool support includes a number of stops 34 on which lock notches 36 in head 14. Mounted below the stops are tube guides 38 for holding a tube to be cut by cutting wheel 40 mounted transversely thereto on block 24.

Block 24 is connected to support 12 by stabilizer bar 42 passing therethrough to prevent twisting and by main screw bar 44 rotated by speed bar handle 46. By rotating handle 46, clamped tube 32 is brought against the selected swaging flaring end 16 which penetrates it and flares it to the selected diameter such as $\frac{1}{4}$; $\frac{3}{8}$; $\frac{1}{2}$ or 7/16 inches or more.

The lower end of tool support 12 is formed with an arcuate concave bending surface 48. Eccentrically mounted in a slot 50 by pin 52 is a lever 54 with a telescoped hand. On the side of the lever is mounted a bending wheel 58 which has concave periphery. A cup-shaped holder 60 is fixed under the lower end of support 12 and receives therein a tube to be bent manually against the arcuate concave bending surface 48.

The operation and use of the invention hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

I claim:

1. A swaging tool assembly, comprising, in combination, a tool support; a head rotatably mounted atop said support and having a plurality of flaring ends radiating therefrom; notches in said head below said ends; stops on said tool support; spring means urging said notches onto said stops; tube bending means on said tool support; a tube holding block carrying clamping means for clamping a tube in line with one of said flaring ends; screw means for advancing said block toward said tool support; cooperating tube guides on said support and tube cutting means on said block.

2. The invention as recited in claim 1, further including a stabilizer bar fixed at one end in said tool support and having its other end slidably in said block.

3. The invention as recited in claim 1, wherein said tube bending means include a concave arcuate bending surface in said support; a lever and a bending wheel for pressing a tube against said surface; said wheel having a concave periphery for holding said tube on the said surface.

4. The invention as recited in claim 1, wherein said bending means include a concave arcuate bending surface formed in the lower end of said tool support and a tube receiving sleeve fixed immediately adjacent said surface to hold the end of a tube while said tube is manually bent in and against said surface.

5. A swaging tool assembly comprising, in combination, a tool support, a head externally mounted by rotatable pivot means to said tool support and having a plurality of flaring ends radiating therefrom, a tube holding block carrying clamping means for clamping a tube along a given axis, together with cooperating notch and stop means to detachably stop the head in one of several stop positions wherein a different individual flaring end is aligned along the said given axis of the tube holding block in each said stop position, screw means for advancing said block toward said tool support, together with a stabilizer bar fixed at one end in said stool support and having its other end slidably mounted in said block.

6. The invention as recited in claim 5 in which tube guide means and tube cutting means are mounted to the assembly, with one of said tube guide and tube cutting means mounted to the tube holding block and the other of said tube guide and tube cutting means mounted to the tool support.

* * * * *